US006099297A

United States Patent [19]

Chan

[11] Patent Number: 6,099,297

[45] Date of Patent: Aug. 8, 2000

[54] CHILDPROOF CIGARETTE LIGHTER

[75] Inventor: Leung Chan, Hong Kong, The Hong Kong Special Administrative Region of the People's Republic of China

[73] Assignee: Cli-Claque Campany, Limited, The Hong Kong Special Administrative Region of the People's Republic of China

[21] Appl. No.: 09/332,507

[22] Filed: Jun. 14, 1999

[51] Int. Cl.[7] ..... F23D 11/36

[52] U.S. Cl. ..... 431/153; 431/277

[58] Field of Search ..... 431/153, 277, 431/255

[56] References Cited

U.S. PATENT DOCUMENTS

| | | | |
|---|---|---|---|
| 2,498,377 | 2/1950 | Nissen | 431/153 |
| 3,576,471 | 4/1971 | Schumacher | 431/255 |
| 3,741,714 | 6/1973 | Yoshinaga | 431/255 |
| 3,817,692 | 6/1974 | Retzlerr | 431/255 |
| 5,271,731 | 12/1993 | Hsin-Chung | 431/153 |
| 5,324,193 | 6/1994 | Pan | 431/153 |
| 5,538,417 | 7/1996 | Chan | 431/153 |

FOREIGN PATENT DOCUMENTS

| | | | |
|---|---|---|---|
| 2280029 | 2/1976 | France | 431/277 |

*Primary Examiner*—Carl D. Price
*Attorney, Agent, or Firm*—Hall, Priddy, Myers & Vande Sande

[57] ABSTRACT

A cigarette lighter is disclosed. It operates by means a lever which opens a valve to release gas from a tank and a spark means to ignite the released gas.

The lighter has a safety mechanism which prevents unintentional operation of the lighter, eg. by a child, but which an adult can easily overcome.

The safety device is in the form of a resilient leg, one end of which is attached to the lever and the other end of which, in the non-use position, engages a surface of a block mounted in the body of the lighter.

6 Claims, 3 Drawing Sheets

CHILDPROOF CIGARETTE LIGHTER

The present invention relates to a cigarette lighter, and in particular to a cigarette lighter with a safety-mechanism whereby accidental operation of the lighter, particularly by a young child, is prevented

BACKGROUND TO THE INVENTION

Re-fillable lighters are known and their operation involves a straightforward push button action to open a valve, release gas from a tank and to ignite the gas by means of a spark. Also known from U.S. Pat. No. 5,538,417 is an ultra-thin cigarette lighter with a self retrieving safety mechanism which is simple and easy for an adult to operate and which can reliably prevent unintentional use of the lighter. Such a cigarette lighter operates by acting on a push button which opens a valve to release gas from a tank and activates a sparking means for igniting the released gas. The lighter has a "self-retrieving" safety mechanism which is simple and easy for an adult to operate and which can reliably prevent unintentional operation of the lighter, such as by a child. The safety mechanism is in the form of an elongated resilient bar provided at one end with an operating member located in a first short portion of a slot in the push button. Said safety mechanism having a normal position in which the safety device prevents operation of the push button by engaging an end portion of said first slot portion, and an operating position, to which the safety device can be moved by means of the operating member into a second slot portion in said push button of a longer length than said first slot portion and in which the push button can be operated, the safety device automatically returning to its normal position after use of the cigarette lighter.

The operation of the cigarette lighter of U.S. Pat. No. 5,538,417 is a two-step process.

Also known from U.S. Ser. No. 09/218174 is a cigarette lighter comprising;

- a tank for a combustible gas under pressure;
- a valve which is normally closed to prevent gas from exiting the tank, but which can be opened to allow gas to escape from the tank through a nozzle;
- a valve actuator operable to open the valve;
- a spark means operable to produce a spark in the vicinity of the nozzle and cause ignition of gas escaping from the tank when the valve is opened by the valve actuator;
- a spark means holder having an upstanding extension;
- a push button operable by engagement of a user's finger to operate the valve actuator, open the valve and operate said spark means, and
- a movable safety device in the form of an elongated resilient bar provided at one end with a rotatable operating member and at the other end with an extension said safety device having a normal position, in which the safety device prevents operation of the push button by means of the extension engaging the end of the upstanding extension of the spark means holder, and an operating position, to which the safety device can be moved by rotation of the operating means, whereby the extension of the safety device is moved out of engagement with the end of the upstanding extension of the spark means holder simultaneously as the push button is pushed inwards so that the extension moves down the side of the upstanding extension, returning to its normal position after use of the cigarette lighter.

BRIEF SUMMARY OF THE INVENTION

It is an object of the present invention to provide a cigarette lighter with a self-retrieving safety mechanism which is simpler and easier for an adult user to operate than known devices, but which can reliably prevent unintentional use of the lighter, eg. by a child.

In accordance with the invention there is provided a cigarette lighter comprising

- a tank for a combustible gas under pressure;
- a body mounted on said tank;
- a wind shield mounted on the body;
- a valve which is normally closed to prevent gas from exiting the tank, but which can be opened to allow gas to escape from the tank through a nozzle;
- a valve actuator operable to open the valve;
- a flint holder in the body for holding a flint;
- a spark producer operable to rub against the flint to produce a spark in the vicinity of the nozzle and cause ignition of gas escaping from the tank when the valve is opened by the valve actuator;
- a lever connected to said valve actuator, wherein said lever is movable by a user's finger from a non-use position to a depressed position to cause the valve actuator to open the valve; and
- a safety device in the form of a resilient leg, a first end of which is attached to the lever and a second end of which, when said lever is in the non-use position, engages a surface of a block mounted in the body.

Movement of the lever from the non-use position to the depressed position causes (1) the second end of the resilient leg to disengage from the surface of said block and (2) distortion of at least part of the flint holder. When said lever is released from said depressed position, the flint holder returns to its original condition and the lever returns to the non-use position whereby the second end of said safety device is reset to engage the surface of said block.

BRIEF DESCRIPTION OF THE DRAWINGS

The present invention will be described, by way of example, with reference to the accompanying drawings in which.

Figure 1B:
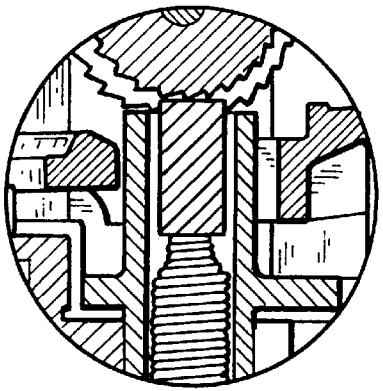
FIG. 1 is a vertical section through a cigarette lighter in accordance with the present invention with the safety device and lighter in normal, non-operating position.

As shown in the drawings, the cigarette lighter of the present invention comprises a gas tank 5, a body 9 mounted on the tank 5 and a windshield 10 mounted on the body 9. The cigarette lighter is provided with an operating lever 1 which is provided with a downwardly depending resilient leg 1*a*, a bifurcated extension 1*b* which surrounds and engages a nozzle 6 and across arm 1*c*. A flint 4 is held by flint holder 9*a*.

Figure 2:
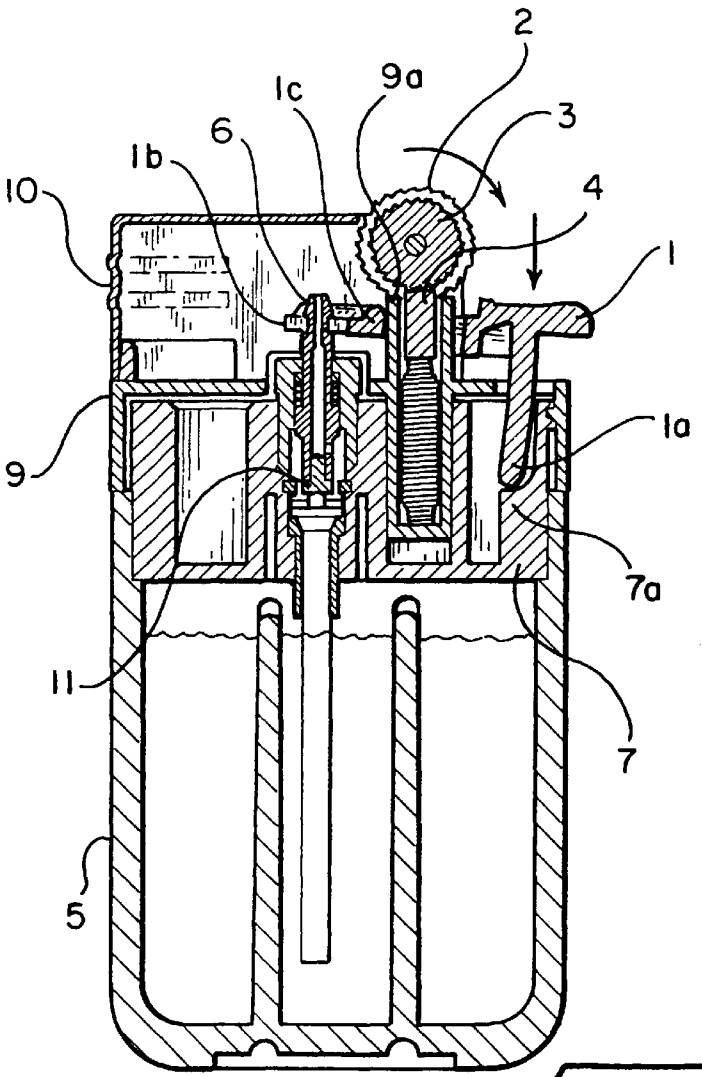
FIG. 2 is a vertical section through the cigarette lighter of FIG. 1 with the safety device and lighter in a semi-operating position.
Figure 3B:
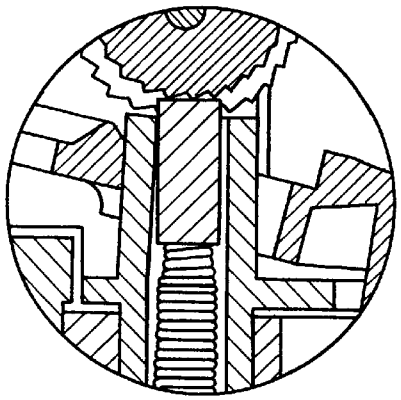
FIG. 3 is a vertical section through the cigarette lighter of FIG. 1 with the safety device and lighter in a fully operating position.
Figure 3A:
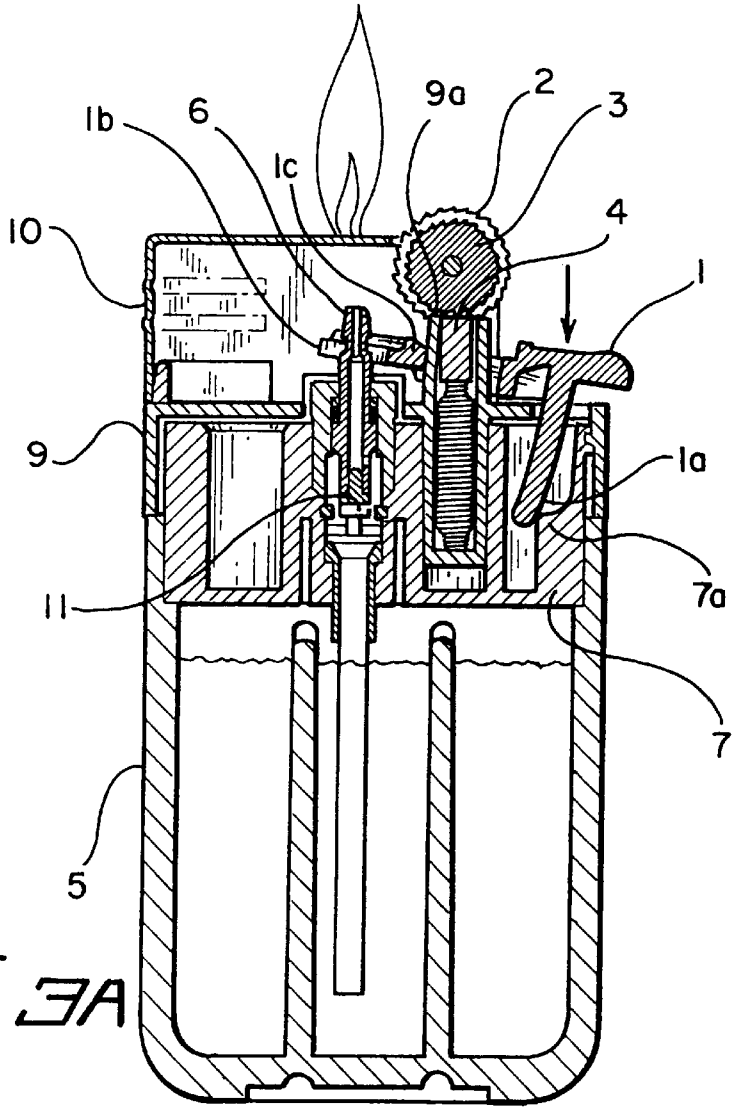

A rotatable wheel 2 drives an internal wheel 3 which rubs against the flint 4 to produce a spark. The nozzle 6 is raised by means of extension 1*b*, and valve 11, is opened and releases gas from the gas tank 5 when lever 1 is depressed as shown in FIGS. 2 and 3. A flame is produced when the spark from the flint 4 ignites the gas from tank 5.

As a user depresses lever 1, this causes the cross arm 1*c* to engage the bendable flint holder 9*a* inducing an upper portion of the flint holder engaged by the cross-arm to distort sidewards.

Figure 1A:
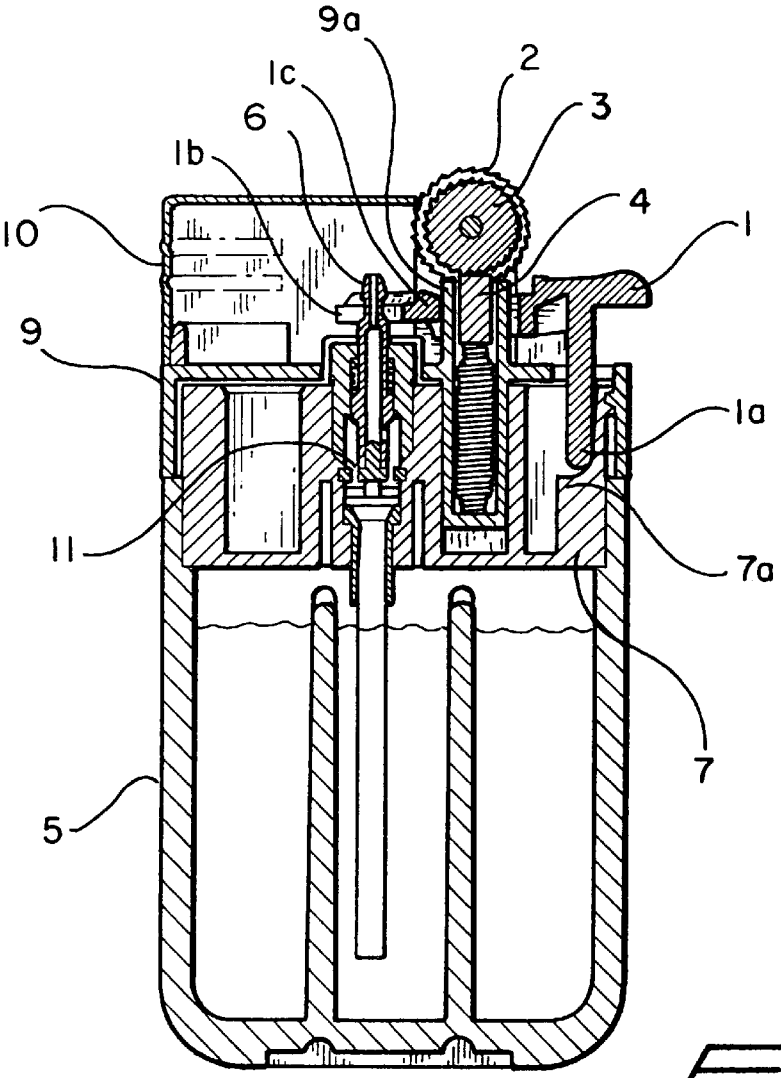

When pressure on lever 1 is released extension 1*b* and the flint holder 9*a* return to the positions shown in FIG. 1 and the nozzle 6 falls to its original position and closes valve 11. As the lever 1 is released.

In the position illustrated in FIG. 1, gentle pressure such as that of a child applied to lever 1 will not cause depression of lever 1 due to the fact that leg 1*a* engages platform 7*a* of block 7 and movement is prevented. However, firmer pressure such as that of an adult applied to lever 1 causes the resilient leg 1*a* to bend as shown in FIG. 2 and eventually to slide off the platform 7*a* of block 7 as shown in FIG. 3 so allowing full depression of lever 1 resulting in the action to release and ignite the gas as described above.

To produce the spark to ignite the gas, it is of course essential that the wheel 2 be rotated at the same time as lever 1 is depressed and this again is a feat a child would be incapable of.

A latitude of modification, change and substitute is intended in the foregoing disclosure and accordingly, it is appropriate that the appended claims be constructed broadly and on a manner consistent with the spirit and scope of the invention herein.

What is claimed is:

1. A cigarette lighter comprising a tank for a combustible gas under pressure;

a body mounted on said tank;

a wind shield mounted on the body;

a valve which is normally closed to prevent gas from exiting the tank, but which can be opened to allow gas to escape from the tank through a nozzle;

a valve actuator operable to open the valve;

a flint holder in the body for holding a flint;

a spark producer operable to rub against the flint to produce a spark in the vicinity of the nozzle and cause ignition of gas escaping from the tank when the valve is opened by the valve actuator;

a lever connected to said valve actuator, wherein said lever is movable by a user's finger from a non-use position to a depressed position to cause the valve actuator to open the valve; and a safety device in the form of a resilient leg, a first end of which is attached to the lever and a second end of which, when said lever is in the non-use position, engages a surface of a block mounted in the body;

wherein movement of said lever from said non-use position to said depressed position causes (1) said second end of said resilient leg to disengage from said surface of said block and (2) distortion of at least part of said flint holder; and wherein, when said lever is released from said depressed position, said flint holder returns to its original condition and said lever returns to said non-use position, whereby said second end of said safety device is reset to engage said surface of said block.

2. A cigarette lighter as claimed in claim 1, wherein the valve actuator is bifurcated to surround and engage the valve.

3. A cigarette lighter as claimed in claim 1, wherein the spark producer comprises an outer wheel which drives an inner wheel which rubs against said flint.

4. A cigarette lighter as claimed in claim 1, wherein the lever, valve actuator and safety device are formed integrally.

5. A cigarette lighter as claimed in claim 4, wherein the lever, valve actuator and safety device are formed of a plastic material.

6. A cigarette lighter as claimed in claim 4, wherein the lever, valve actuator and safety device are formed of an elastic material.

* * * * *